US006113295A

United States Patent [19]

Bordelon

[11] Patent Number: 6,113,295

[45] Date of Patent: Sep. 5, 2000

[54] MAGNIFICATION/WRITING INSTRUMENT

[76] Inventor: Lewis O. Bordelon, 4319 Hamilton St., New Orleans, La. 70118

[21] Appl. No.: 09/275,530

[22] Filed: Mar. 24, 1999

[51] Int. Cl.[7] ..... B43K 29/00

[52] U.S. Cl. ..... 401/195; 359/803; 359/809

[58] Field of Search ..... 401/52, 195; 359/802, 359/803, 808, 809, 810

[56] References Cited

U.S. PATENT DOCUMENTS 5,754,349 5/1998 Hon ..... 359/813

*Primary Examiner*—Steven O. Douglas
*Assistant Examiner*—Peter deVore
*Attorney, Agent, or Firm*—Joseph J. Regard, Ltd.

[57] ABSTRACT

A writing instrument, such as an ink pen or the like, having a body having first and second ends, with a ball point or other writing tip associated with the first end. The body has a slot formed along its length to accommodate a flexible magnification lens configured to slidingly engage the slot so as to allow the user to urge a portion of the lens outside of the body of the pen via a button or the like mounted adjacent to an end of the lens. The lens may be formed in a fresnel configuration, and is mounted such that the second end of the lens remains in the slot so as to support the portion of the lens removed from the slot. The removed portion is configured to suspend from the writing utensil body, in the vicinity of the first end, so as to allow the user to view written indicia on a surface adjacent to the first end of the utensil. An alternative embodiment of the invention contemplates an adapter for an off-the-shelf writing utensil in the form of an enveloping sheath configured to convert the writing utensil to include the magnification system of the present invention. An alternative embodiment of the invention contemplates an adapter for an off-the-shelf writing utensil in the form of an enveloping sheath configured to convert the writing utensil to include the magnification system of the present invention.

18 Claims, 5 Drawing Sheets

MAGNIFICATION/WRITING INSTRUMENT

TECHNICAL FIELD OF THE INVENTION

The present invention relates to writing instruments such as ink pens, pencils, and the like, and in particular to a magnification/writing instrument in the form of a pen having an elongated body having first and second ends, with a ball point or other writing tip associated with the first end. The body of the instrument has a slot formed along its length to accommodate a flexible magnification lens configured to slidingly engage the slot, and protrude from the body in a dispensed position for use by the user.

Further provided is a raised button adjacent to one end of the lens configured to be situated exterior the body of the pen, through the slot, so as to allow the user to urge an exposed end of the lens, which may be, for example, a fresnel lens, outside of the body of the pen via sliding the button along the length of the slot, with the second end of the lens remaining supported by the body so as to support the portion of the lens removed from the slot. The removed portion is configured to suspend from the writing utensil body, in the vicinity of the first end, so as to allow the user to view written indicia on a surface adjacent to the first end of the utensil.

An alternative embodiment of the invention contemplates an adapter for an off-the-shelf writing utensil in the form of an enveloping sheath configured to convert the writing utensil to include the magnification system of the present invention.

The present invention thereby provides an inexpensive, easily implemented system for providing a user a magnified view of a writing surface for writing or reading.

BACKGROUND OF THE INVENTION

While the prior art does contemplate the general concept of a writing instrument having a magnification lens affixed thereto it is submitted that the arrangements contemplated are either impractical, lack functionality in everyday use, or do not adequately lend themselves to be used in conjunction with an ordinary writing instrument design.

A listing of patents which may be of some pertinence to the present invention include:

| Patent Number | Inventor(s) | Date of Issue |
|---|---|---|
| 1306203 | Tippit | 06/10/1919 |
| 1353279 | Schulthess | 09/21/1920 |
| 1479885 | Appler | 06/08/1924 |
| 1658499 | Stevens | 02/07/1928 |
| 2172597 | Simpson | 09/12/1939 |
| 2234942 | Nichols | 03/11/1941 |
| 3343292 | Jorgensen | 09/26/1967 |
| 4044889 | Orentreich et al | 08/30/1977 |
| 4398800 | Hayes | 08/16/1983 |
| 5074695 | DeRosa | 12/24/1991 |
| 5309643 | McCollom | 05/10/1994 |
| 5358297 | Coleman | 10/25/1994 |
| 5412199 | Finkelstein et al | 05/02/1995 |
| 5491589 | Haymond | 02/12/1996 |
| 5608203 | Finkelstein et al | 03/04/1997 |
| Des 275,401 | Henkels | 09/04/1984 |

U.S. Pat. No. 4,398,800 teaches a "Magnifying Device for a Hand Held Implement" which includes a magnification lens configured to communicate with the body of the device, the lens affixed via ball joint connection to allow same to be positioned in the vicinity of the writing tip of the device, so as to allow the user to view indicia on a surface adjacent to the writing tip.

U.S. Pat. No. 5,309,643 teaches a rectangular lens situated in proximity to the tip of a writing instrument, to allow the user to view the paper or other surface in communication with the writing tip.

U.S. Pat. Nos. 2,234,942, 2,172,597, 1,479,885, and 1,306,203 teach various magnification lens built into the body of the writing utensils, although these lenses are fixed in place, unlike the searched for invention.

U.S. Pat. Nos. 5,074,695 and 5,358,297 teach magnifying glasses pivotally engaged to a pen and a set of tweezers, respectively.

U.S. Pat. Nos. 5,412,199 and 5,608,203 teach credit cards having fresnel lens built in, to allow the user to read a line of text on a paper or the like.

While the prior art does contemplate the general concept of a lens affixed to a writing utensil, it is submitted that the teachings do not teach or suggest, alone or in combination, the teachings of the present invention.

GENERAL SUMMARY DISCUSSION OF THE INVENTION

Unlike the prior art, the present invention provides a magnification system for utilization with a writing utensil which is cheaper to manufacture, easier to use, and more effective than the known prior art systems, providing an inexpensive, easily implemented system for aiding a user a magnified view of a writing surface for writing or reading The preferred embodiment of the present invention comprises a writing instrument in the form of, for exemplary purposes, an ink pen having about the same dimensions as any other ordinary pen, with a body having first and second ends, a ball point or other writing tip associated with the first end.

The body of the pen has a slot formed along its length to accommodate a flexible magnification lens, the lens configured to slidingly engage the slot so that is enveloped within the body when not in use, and having a raised button protruding through the slot so as to allow the user to slide the button along the slot, urging the exposed end of the lens, which may be, for example, a fresnel lens, out of the slot and in a relatively lateral or angular position relative to the body, with the second end of the lens remaining in the slot so as to support the lens.

The exposed portion is configured to suspend from the writing utensil body, in the vicinity of the first end, so as to allow the user to view written indicia on a surface adjacent to the first end of the utensil while holding the writing instrument in a writing position.

An alternative embodiment of the invention contemplates an adapter for an off-the-shelf writing utensil in the form of a partially enveloping cover or sheath configured to convert the writing utensil to include the magnification system of the present invention.

A second alternative embodiment of the invention includes the addition of lighting means for lighting the lens in order to illuminate and magnify an area adjacent to the writing tip of a writing instrument.

It is therefore an object of the present invention to provide a writing instrument which includes the capability of magnifying an area by the user for reading, observation, or writing purposes.

It is another object of the present invention to provide an adapter to provide magnification means to an ordinary, off-the-shelf writing instrument.

It is still another object of the present invention to provide a writing instrument which comprises an easily concealed, yet easily dispensed magnification strip which may be used to read material in the vicinity of the writing tip of the instrument.

It is another object of the present invention to provide a writing instrument which includes lighting means to illuminate the magnification strip, in such a manner as to enable a user to illuminate and/or magnify an area adjacent to the writing tip of the instrument.

Lastly, it is an object of the present invention to provide an adapter to adapt an off-the-shelf writing instrument to provide lighting and magnification means in the form of a partially enveloping cover or sheath configured to convert the writing utensil to include the magnification and lighting system of the second alternative embodiment of the present invention.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1:
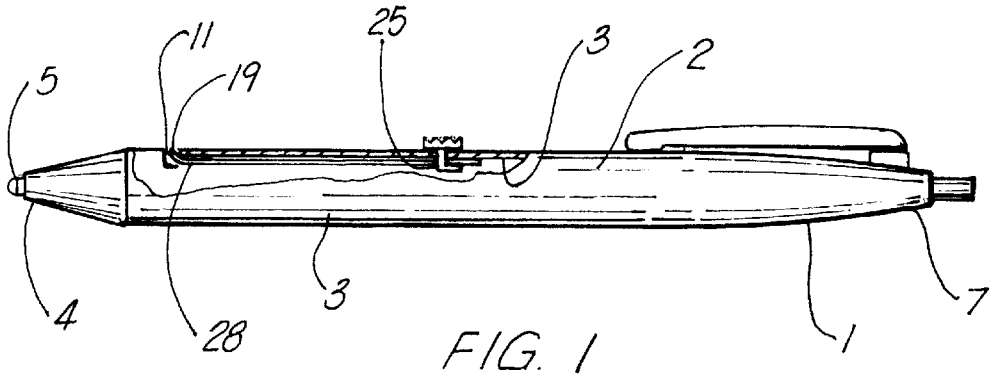
FIG. 1 illustrates a side, partially cut-away view of the preferred embodiment of the present invention, illustrating the location of the magnifying strip in the closed position, and dispensing button therefore exterior the body of the writing utensil.

Referring to FIG. 1, the preferred embodiment of the present invention is incorporated into a writing instrument 1, such as an ink pen, as shown, including a hollow body 2 having a inner 3' and outer 3 sidewalls, a first 4 end which may have a writing tip emanating therefrom, and a second end 7.

Figure 5:
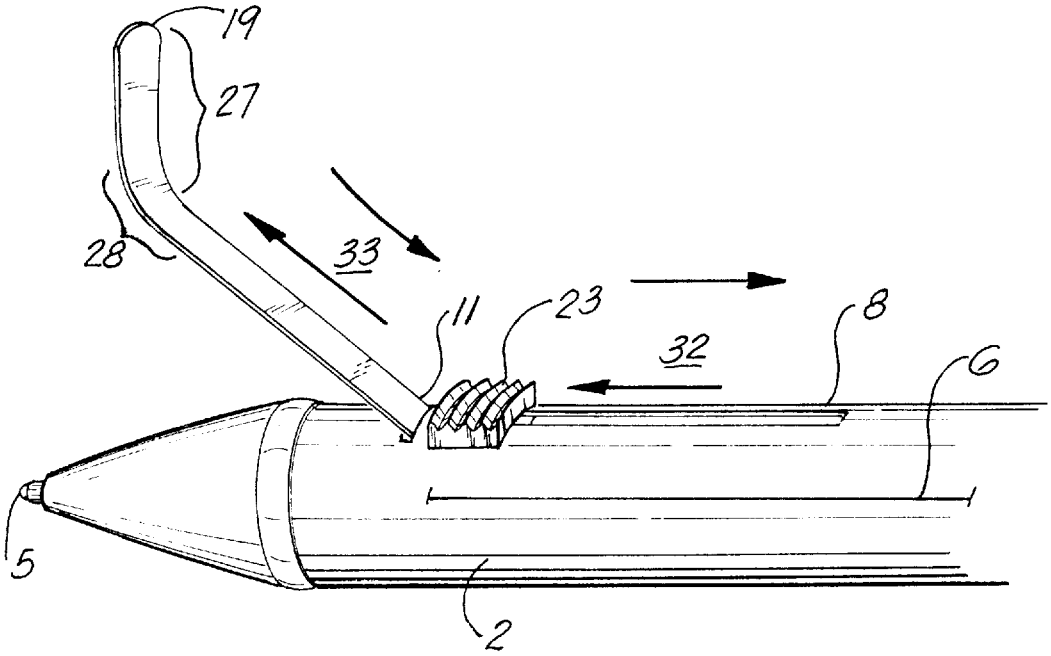
FIG. 5 is an isometric view of the invention of FIG. 1, illustrating the magnification strip urged via the dispensing button into the exterior, magnification position.
Figure 6:
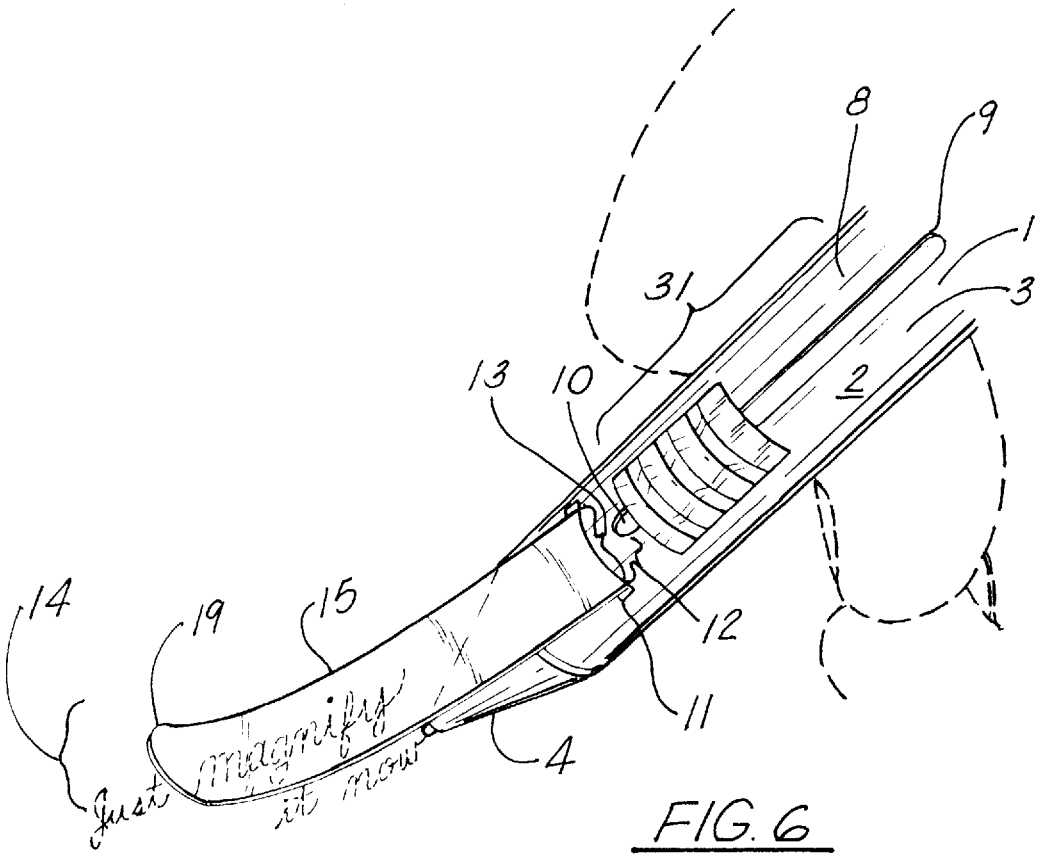
FIG. 6 is an upper, isometric view of the invention of FIG. 5, with the dispensed magnification strip in the vicinity of the writing tip of the writing instrument, magnifying the area in the vicinity thereof.

Continuing with FIGS. 5 and 6, the body 2 has formed through the sidewall 3 a longitudinal slot 8, the slot having second 8 and first 9 ends and a length 31 aligned with the longitudinal axis 6 of body 2, the first end 9 of slot formed near, but spaced from, the first end 4 of the writing instrument.

Formed in the body 2 in general perpendicular relationship with the longitudinal slot 8, between the first 9 end of the slot and the first end 4 of the writing instrument is a lateral slot 11 having a width 13 and spaced 12 from longitudinal slot 8.

Continuing with FIGS. 2–6, a generally flat 16 lens 15, which may be, for example, a fresnel type, is provided having a thickness 17 adequate to pass through lateral slot 11, the lens having first 19 and second 18 ends, a top side 29 and a bottom side 30 and a length 21, the length preferably corresponding with the length 31 of longitudinal slot 8. As shown, a radial curve 20 or bend 28 is formed in the lens in the vicinity of the first 19 end, directed upward from the top side 29 to form a viewing area 27, as well as to facilitate egress of the lens from the body of the pen, as will further be discussed infra.

Situated in spaced relationship 24 from the top side 29 of the lens in the vicinity of the second end 18 is a button 22 having a grip pad 23 supported above the lens 15 by support member 25 and fastened by fastener 26.

Continuing with FIGS. 1–6, the lens 15 is situated within the body 2 of the pen in longitudinal fashion, adjacent to the inner sidewall 3' such that the grip pad 23 of button 22 is exterior the body of the pen, with the support member 25 passing through longitudinal slot 8 and the first end 19 of lens 15 in communication with lateral slot 11 such that a user urging grip pad 23 outward 32 toward writing tip or first end 4 dispenses 33 the first end 19 of lens out of the body in a manner which allows the user, holding the writing utensil 1 in a writing position, to view through lens 15 to magnify an area adjacent to the first end 4 or writing tip (FIG. 6), placing the lens in a dispensed position.

As shown, the bend 28 or radial curve 20 not only facilitates dispensing with the upwardly directed portion at the first end threading through the lateral slot when being dispensed, but also directs the lens away from the body when in the dispensed position to facilitate viewing by the user through the lens while holding the writing instrument in the writing position.

Figure 2:
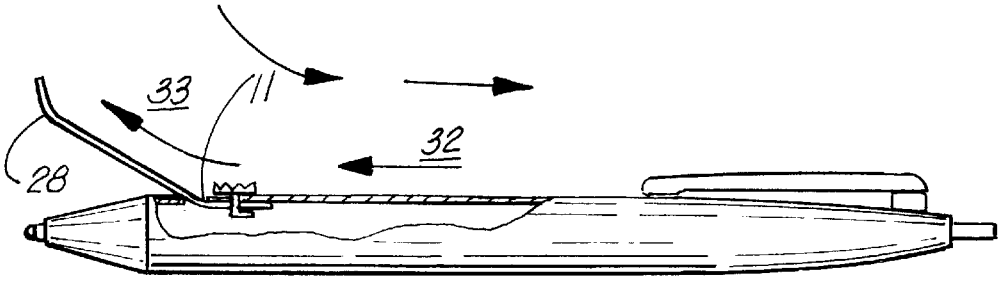
FIG. 2 illustrates a side, partially cut-away view of the invention of FIG. 1, illustrating the magnification strip urged via the dispensing button into the exterior, magnification position.
Figure 3:
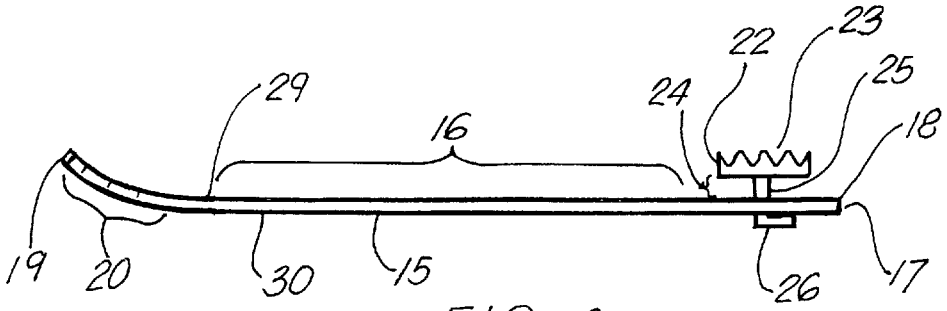
FIG. 3 is a side view of the magnification strip, illustrating an exemplary configuration therefore, along with the mounting configuration for the dispensing button.
Figure 4:
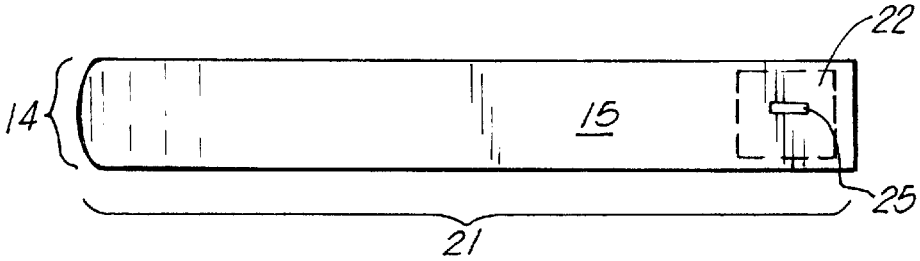
FIG. 4 is a top view of the magnification strip of FIG. 3.

After the lens has been utilized by the user in its open position, as shown in FIGS. 2 and 5, the user may retract same into the body of the writing instrument by urging the grip pad 23 away from the first end 4 and writing tip 5, facilitating the lens to slide back through lateral slot 11 and into the body 2.

Figure 7:
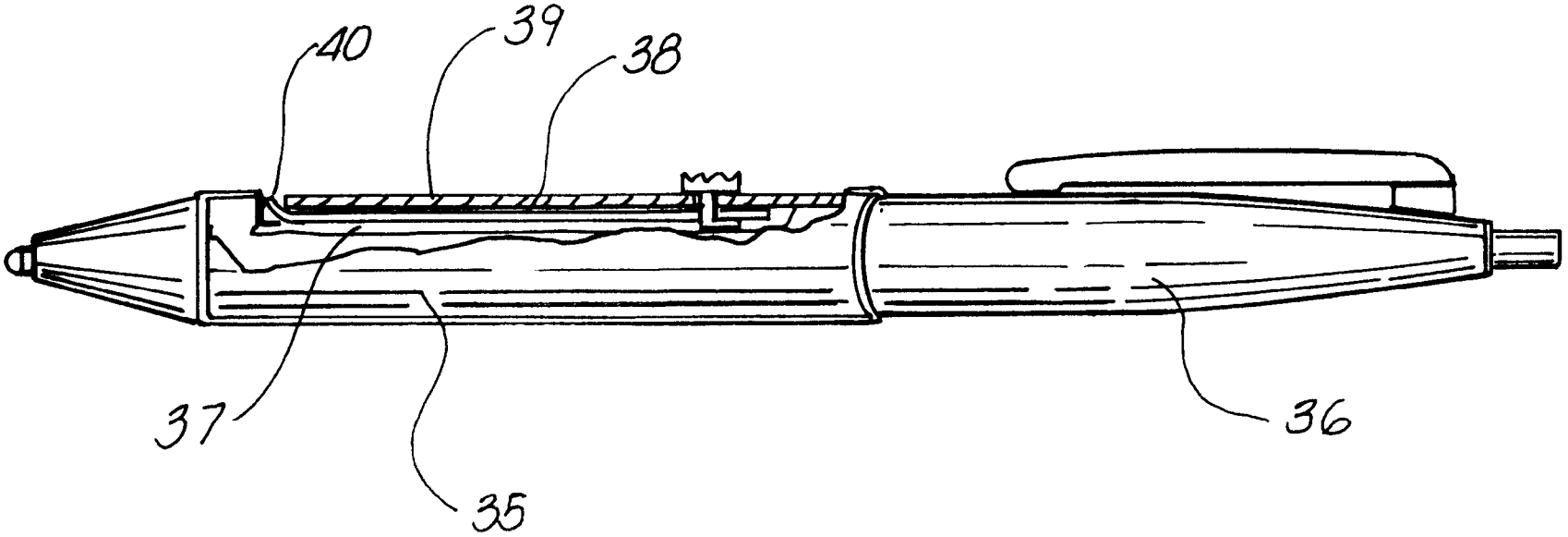
FIG. 7 is a side, partially cut-away view of a first alternative embodiment of the invention of FIG. 1, illustrating an adapter configured to slide over an off-the shelf writing instrument, the adapter configured to envelope the portion of the writing instrument adjacent to the writing tip, converting the writing instrument to provide magnification.

FIG. 7 illustrates a first alternative embodiment of the present invention, wherein an adapter in the form of an enveloping shell 35 having a conduit therethrough is provided to engage the outer body of an off-the-shelf pen 36 by slipping the shell over same. As shown, the shell has a longitudinal compartment 37 to hold the lens 38, and a longitudinal slot 39 and lateral slot 40 with a construction and operation similar to that taught in the preferred embodiment, supra.

The user would merely slip the adapter over the body of a pen so that the lateral slot is adjacent to the writing tip. The adapter may be held in place via friction or adhesive, as is desired.

Figure 9:
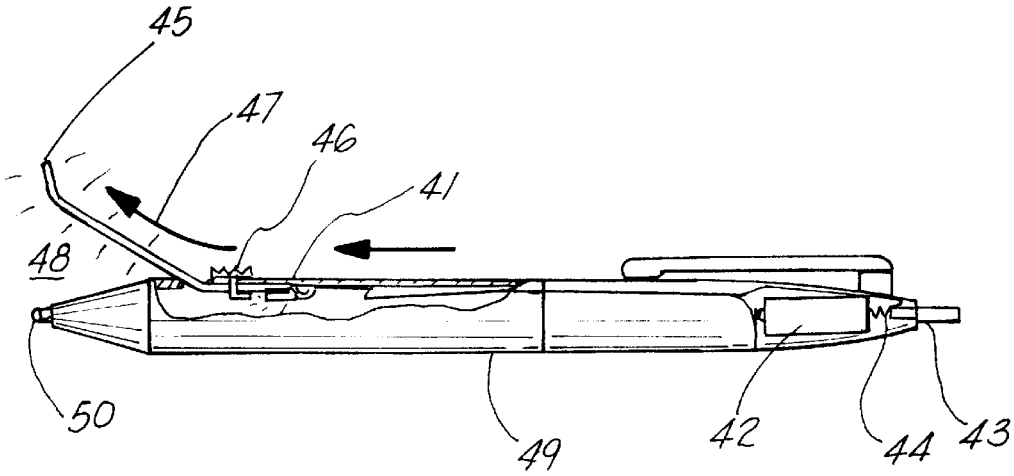
FIG. 9 illustrates a second alternative embodiment of the invention of FIG. 1, teaching the additional feature of an illumination source placed in contact with the enclosed end of the magnification strip, so as to, on demand, illuminate same, providing illumination and magnification to the user when desired.
Figure 10:
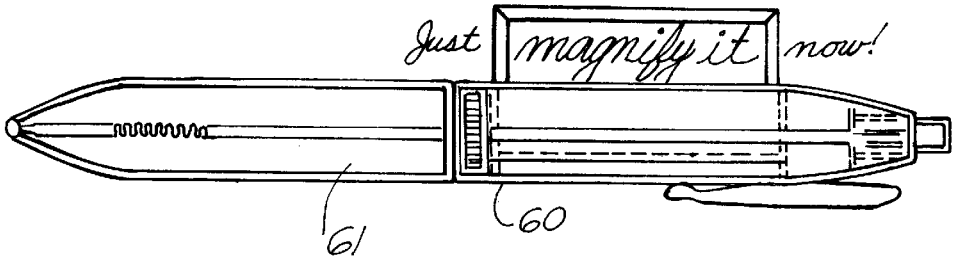
FIG. 10 illustrates a fourth alternative embodiment of the present invention, wherein the magnifier is dispensed longitudinally relative to the pen body.
Figure 11:
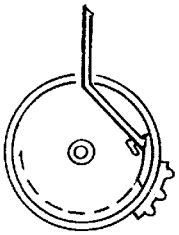
FIG. 11 is an end, cross sectional view of the invention of FIG. 10.
Figure 12:
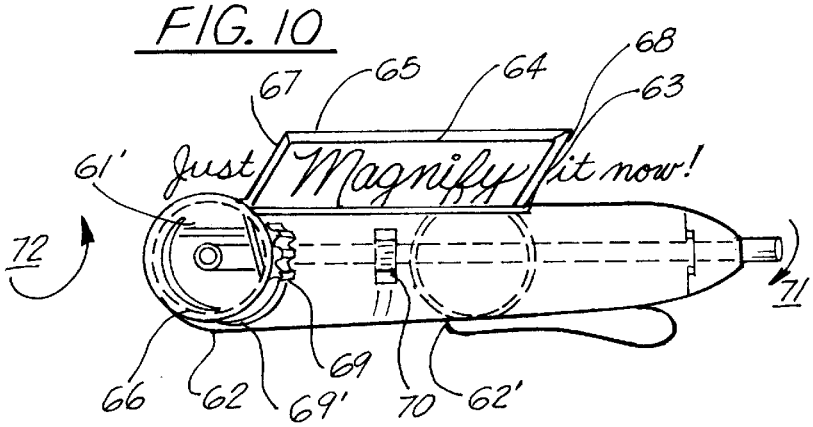
FIG. 12 is an isometric, partially cut-away view of the invention of FIG. 10.
Figure 13:
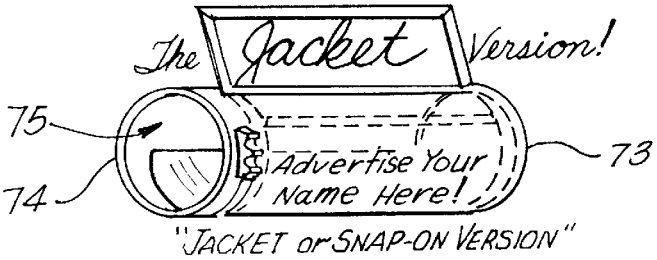
FIG. 13 is an isometric, partially cut-away view of a fourth embodiment of the invention, illustrating an adapter version of the invention of FIG. 10.

FIG. 9 illustrates a second alternative embodiment of the invention, wherein there is further provided a build in light emitter 41, in the form of, for example, a light emitting diode in the body 49 of the writing instrument, and in communication with lens 45. The light emitter is powered by a battery or other power supply 42 which may be engaged via push-button 43 switch 44 or by dispensing 47 the lens from the body via trip pad 46, so as to facilitate energizing of the light emitter 41, providing light from within the body of the writing instrument, which light is passes through lens like a fiber optic cable to illuminate 48 the exposed lens extending from the body, as well as an area in the vicinity of the first end 50 of body 49, which may include a writing or other surface, thereby providing both illumination and magnification, facilitating use in dark or low light areas.

Figure 8:
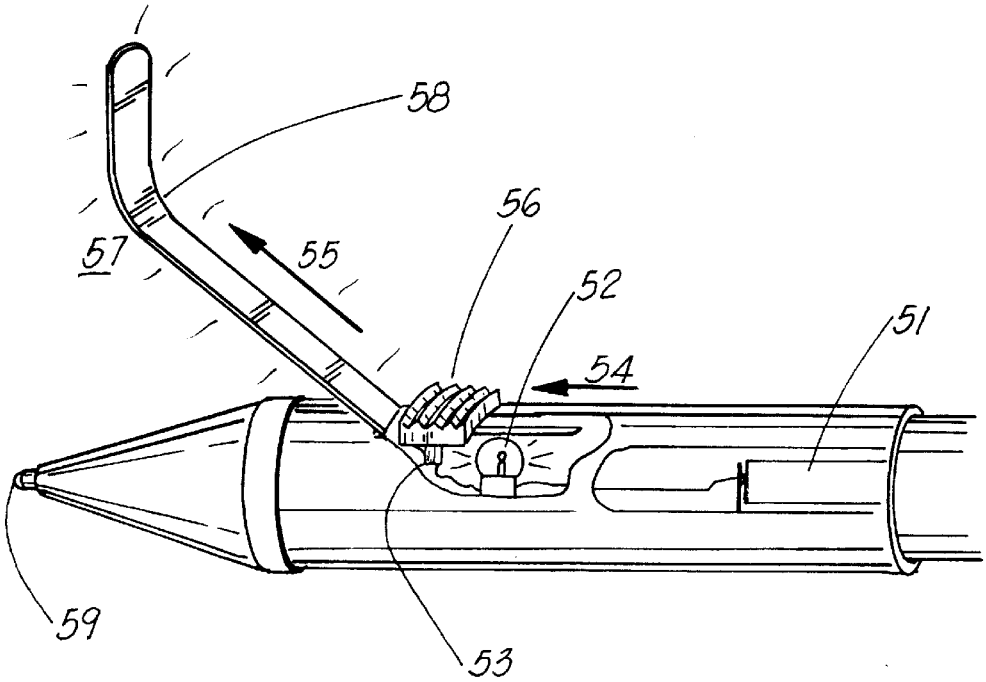
FIG. 8 illustrates a third alternative embodiment of the invention of FIG. 1, illustrating an adapter like that taught in FIG. 8, but with the additional feature of an illumination source placed in contact with the enclosed end of the magnification strip, so as to, on demand, illuminate same, providing illumination and magnification to the user when desired.

FIG. 8 teaches a third alternative embodiment of the invention, wherein the second embodiment, above is provided in an adapter form configured to slip over an off-the-shelf pen. As shown, a shell in the form of the device of FIG. 7 is provided with the addition of a light emitter and power supply within the shell, as generally discussed in the discussion of FIG. 9, above. This embodiment of FIG. 8, however, may have to have an increased thickness compared to the shell of FIG. 7 to accommodate the power supply 51 and light emitter 52.

Actuation of the power supply may occur via switch 53 configured to engage upon the urging 54 the grip pad 56 towards the writing tip 59, dispensing 55 the lens, the switch the providing power via power supply to light emitter, which is situated within the shell adjacent to the lens, illuminating 57 same.

FIGS. 10–13 teach a fourth embodiment 60 of the present invention, wherein there is provided a pen having a body 61 having a cavity having an inner wall 61' wherein there is formed first 62 and second 62', facing grooves formed therein, the body having a longitudinal slot 63 formed between said first and second grooves configured to accommodate a flexible lens 64 having a first edge 65, and a second edge 69 having an activation button 66 affixed thereto, configured to be exposed outside of the body for manual operation by a user. The lens further has first 67 and second 68 lens configured to be slidingly engaged to the first 62 and second 62' ends, respectively, such that the first edge 65 is exposed outside of the body, allowing the user to read through it upon guiding the activation button 66 along slot 69' in a clockwise 72 direction, or enclose the lens to within the body by directing the activation button along slot 69' in a counter clockwise 71 direction. The embodiment shown, therefore, provides a lens having a body which is wrapped about the longitudinal axis of the body of the pen in a storage position, and is dispensed in a wide capacity from the body, which can provide a greater viewing area.

Alternately, an activation button 70 can be placed in medial relationship to the lens, as opposed to the edge connection shown in button 66.

An alternative embodiment 73 of the present invention teaches a body 74 having a longitudinal cavity 75 formed therethrough configured to envelope the body of an off-the-shelf pen, converting said pen into a magnification pen.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

ELEMENTS OF THE INVENTION

| Element | Description |
|---|---|
| 1 | writing utensil |
| 2 | body |
| 3 | sidewall |
| 4 | first end |
| 5 | writing tip |
| 6 | longitudinal axis |
| 7 | second end |
| 8 | longitudinal slot |
| 9 | first end |
| 10 | second end |
| 11 | lateral slot |
| 12 | spaced distance |
| 13 | width of slot |
| 14 | width of lens |
| 15 | lens |
| 16 | flat |
| 17 | thickness |
| 18 | second end |
| 19 | first end |
| 20 | radial curve |
| 21 | length |
| 22 | button |
| 23 | grip pad |
| 24 | spaced |
| 25 | support member |
| 26 | fastener |
| 27 | flat end |
| 28 | bend |
| 29 | top side |
| 30 | bottom side |
| 31 | length of slot |
| 32 | urging outward |
| 33 | directed away from writing tip |
| 34 | retract |
| 35 | shell |
| 36 | off-the-shelf pen |
| 37 | compartment |
| 38 | lens |
| 39 | slot |
| 40 | slot |
| 41 | LED |
| 42 | power supply |
| 43 | pushbutton |
| 44 | switch |
| 45 | lens |
| 46 | grip pad |
| 47 | dispense |
| 48 | light illumination |
| 49 | body |
| 50 | first end of instrument |
| 51 | power supply |
| 52 | LED |
| 53 | switch |
| 54 | urging |
| 55 | dispensing |
| 56 | grip pad |
| 57 | illuminate |
| 58 | lens |
| 59 | writing tip |
| 60 | fourth alternative |
| 61 | pen having body |

-continued

| Element | Description |
|---|---|
| 62 | first groove, second groove |
| 63 | longitudinal slot |
| 64 | flexible lens |
| 65 | first edge |
| 66 | activation button |
| 67 | first end lens |
| 68 | second end lens |
| 69 | second edge |
| 70 | alternative placement of activation button |
| 71 | clockwise |
| 72 | counterclockwise |
| 73 | alternative slide on embodiment |
| 74 | body |
| 75 | longitudinal cavity |
| 76 | |
| 77 | |
| 78 | |
| 79 | |
| 80 | |

What is claimed is:

1. A writing instrument, comprising:

an elongated body having a longitudinal axis, an open area formed therein, inner and outer sidewalls, and first and second ends;

a lens of generally uniform thickness having a length, a width, and top and bottom sides, said lens formed of a generally flexible material, said lens configured to fit within said open area formed in said body;

said body further having formed therein a dispensing slot for dispensing said lens, said dispensing slot having a length situated in generally perpendicular relationship with said longitudinal axis of said body, said dispensing slot having a width and length sufficient to enable the passage of said lens therethrough;

dispensing means for dispensing a portion of said lens through said dispensing slot, said dispensing means further comprising retracting means for retracting said lens into said open area formed in said body.

2. The writing instrument of claim 1, wherein there is formed in the lens a bend in the vicinity of the first end of said lens, said bend directing said first end of said lens upward from the top side, so as to facilitate a viewing area therein.

3. The writing instrument of claim 2, wherein said body has formed therein a first slot having first and second ends, and a length in general alignment with said longitudinal axis of said hollow body, said first end of said first slot situated in spaced relationship with said first end of said body, with said dispensing slot situated between said first end of said body and said first slot, and wherein said top side of said lens, in the vicinity of said second end, has a grip pad, said grip pad supported above said lens by a support member, said top side of said lens configured to engage said inner sidewalls of said, with said first end of said lens configured to engage said dispensing slot so as to facilitate the selective dispensing or retraction of said lens therethrough, said support member supporting said grip pad configured to pass between through said first slot such that said grip pad is exterior said body of said pen, such that a user may direct said lens by sliding said grip pad along the length of said first slot, from a storage position within said body to a use position wherein a portion of said lens protrudes from said dispensing slot, said grip pad and first slot forming said dispensing means.

4. The writing instrument of claim 3, wherein said lens is a fresnel-type magnification lens.

5. The writing instrument of claim 3, wherein there is further provided illumination means to illuminate said lens from within said body.

6. The writing instrument of claim 5, wherein said illumination means comprises a light emitting diode, a power supply, and a switch.

7. The writing instrument of claim 6, wherein said switch is linked to said dispensing means.

8. A magnification instrument, comprising:

an adapter having a longitudinal axis, a lens compartment formed therein, a conduit formed therethrough, inner and outer sidewalls, and first and second ends;

a lens of generally uniform thickness having a length, a width, and top and bottom sides, said lens formed of a generally flexible material, said lens configured to fit within said lens compartment formed in said adapter;

said adapter further having formed therein a dispensing slot for dispensing said lens, said dispensing slot having a width and length sufficient to enable the passage of said lens therethrough;

dispensing means for dispensing a portion of said lens through said dispensing slot, said dispensing means further comprising retracting means for retracting said lens into said lens compartment formed in said adapter;

said adapter configured to envelope the body of a writing instrument having a writing tip, such that said writing tip projects from said first end of said adapter.

9. The writing instrument of claim 8, wherein there is formed in the lens a bend in the vicinity of the first end of said lens, said bend directing said first end of said lens upward from the top side, so as to facilitate a viewing area therein.

10. The writing instrument of claim 9, wherein said adapter has formed therein a first slot having first and second ends, and a length in general alignment with said longitudinal axis of said hollow adapter, said first end of said first slot situated in spaced relationship with said first end of said adapter, with said dispensing slot situated between said first end of said adapter and said first slot, and wherein said top side of said lens, in the vicinity of said second end, has a grip pad, said grip pad supported above said lens by a support member, said top side of said lens configured to engage said inner sidewalls of said, with said first end of said lens configured to engage said dispensing slot so as to facilitate the selective dispensing or retraction of said lens therethrough, said support member supporting said grip pad configured to pass between through said first slot such that said grip pad is exterior said adapter of said pen, such that a user may direct said lens by sliding said grip pad along the length of said first slot, from a storage position within said adapter to a use position wherein a portion of said lens protrudes from said dispensing slot, said grip pad and first slot forming said dispensing means.

11. The writing instrument of claim 10, wherein said lens is a fresnel-type magnification lens.

12. The writing instrument of claim 10, wherein there is further provided illumination means to illuminate said lens from within said adapter.

13. The writing instrument of claim 12, wherein said illumination means comprises a light emitting diode, a power supply, and a switch.

14. The writing instrument of claim 13, wherein said switch is linked to said dispensing means.

15. The method of magnifying an area, comprising the steps of:

a. providing a writing instrument, comprising:

an elongated body having a longitudinal axis, an open area formed therein, inner and outer sidewalls, and first and second ends, said first end having a writing tip;

a lens of generally uniform thickness having a length, a width, and top and bottom sides, said lens formed of a generally flexible material, said lens configured to fit within said open area formed in said body;

said body further having formed therein a dispensing slot for dispensing said lens, said dispensing slot situated adjacent to said first end of said body, said dispensing slot having a width and length sufficient to enable the passage of said lens therethrough;

dispensing means for dispensing a portion of said lens through said dispensing slot, said dispensing means further comprising retracting means for retracting said lens into said open area formed in said body;

b. grasping said writing instrument so as to write with said writing tip on a surface;

c. dispensing a portion of lens from said body of said writing instrument;

d. focusing through said lens to provide a clearer view of said surface;

f. retracting said lens into said body.

16. The writing instrument of claim 15, wherein there is further provided illumination means to illuminate said lens from within said body, and wherein there is further provided the step in step "d" of initiating said illumination means to illuminate said lens, and allowing said illuminated lens to illuminate a portion of said surface.

17. The writing instrument of claim 16, wherein there is further provided in step "e" the step of disengaging said illumination means to discontinue illumination of said lens.

18. A magnification instrument, comprising:

an elongated body having a longitudinal axis, a lens compartment formed therein, a conduit formed therethrough, inner and outer sidewalls, and first and second ends;

a lens of generally uniform thickness having a length, a width, and top and bottom sides, said lens formed of a generally flexible material having a generally rectilinear configuration, said lens configured bend so as to fit within said lens compartment formed in said body;

said body further having formed therein a dispensing slot for dispensing said lens from said lens compartment, said dispensing slot having a width and length sufficient to enable the passage of said lens therethrough;

dispensing means for dispensing a portion of said lens through said dispensing slot, said dispensing means further comprising retracting means for retracting said lens into said lens compartment formed in said body.

* * * * *